US006491875B1

(12) United States Patent
Palmas

(10) Patent No.: US 6,491,875 B1
(45) Date of Patent: Dec. 10, 2002

(54) FLUIDIZED PARTICLE CONTACTING PROCESS WITH ELONGATED COMBUSTOR

(75) Inventor: Paolo Palmas, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/429,409

(22) Filed: Oct. 28, 1999

Related U.S. Application Data

(62) Division of application No. 08/854,219, filed on May 9, 1997, now Pat. No. 6,039,863.

(60) Provisional application No. 60/019,596, filed on Jun. 17, 1996.

(51) Int. Cl.[7] ..... B32B 27/04; B01J 10/00; C10G 65/10; C10G 9/00; C10G 11/00

(52) U.S. Cl. ..... 422/139; 422/141; 422/144; 422/145; 422/147; 422/187; 208/46; 208/55; 208/106; 208/108; 208/113

(58) Field of Search ..... 422/143–145, 422/129, 120, 140–142, 139; 208/46, 113, 161; 502/42, 43

(56) References Cited

U.S. PATENT DOCUMENTS

| | | | | |
|---|---|---|---|---|
| 2,902,432 A | | 9/1959 | Codet et al. | 208/113 |
| 3,843,330 A | | 10/1974 | Conner et al. | 23/288 B |
| 3,844,973 A | | 10/1974 | Stine et al. | 252/417 |
| 3,909,392 A | | 9/1975 | Horecky, Jr. et al. | 208/120 |
| 4,118,337 A | | 10/1978 | Gross et al. | 252/417 |
| 4,295,961 A | | 10/1981 | Fahrig et al. | 208/161 |
| 4,385,985 A | | 5/1983 | Gross et al. | 208/113 |
| 4,397,738 A | | 8/1983 | Kemp | 208/161 |
| 4,482,451 A | | 11/1984 | Kemp | 208/161 |
| 4,622,210 A | * | 11/1986 | Hirschberg et al. | 422/144 |
| 4,737,346 A | | 4/1988 | Haddad et al. | 422/144 |
| 4,792,437 A | | 12/1988 | Hettinger, Jr. et al. | 422/147 |
| 4,812,430 A | | 3/1989 | Child | 502/42 |
| 4,944,845 A | | 7/1990 | Bartholic | 202/84 |
| 4,985,136 A | | 1/1991 | Bartholic | 208/153 |
| 5,011,592 A | | 4/1991 | Owen et al. | 208/113 |
| 5,126,036 A | | 6/1992 | Owen | 208/113 |
| 5,143,874 A | | 9/1992 | Ross | 502/42 |
| 5,455,010 A | | 10/1995 | Lomas et al. | 422/144 |
| 5,762,882 A | * | 6/1998 | Lomas | 422/144 |

* cited by examiner

*Primary Examiner*—Marian C. Knode
*Assistant Examiner*—Douglas W. Rudnick
(74) *Attorney, Agent, or Firm*—John G. Tolomei; James C. Paschall

(57) ABSTRACT

A particulate catalyst is regenerated by upward transport in a combustor having an extended length and separated from combustion gases with a single stage of cyclones. The extended length combustor ends with a termination device arranged to tangentially discharge particulate catalyst and gases into an open disengaging vessel and to achieve a high separation efficiency. Initial high separation efficiency provided by the termination device permits a single downstream stage of cyclones to reduce particulate emissions to acceptable levels. The combination of the separation device and the extended combustor can accommodate changes in particulate densities in the extended combustor without inducing cyclone overload.

6 Claims, 2 Drawing Sheets

FLUIDIZED PARTICLE CONTACTING PROCESS WITH ELONGATED COMBUSTOR

CROSS-REFERENCE TO RELATED APPLICATION

This application is a Divisional application of Ser. No. 08/854,219 filed May 9, 1997, now U.S. Pat. No. 6,039,863, which application claims priority from Provisional Application No. 60/019,596, filed Jun. 17, 1996, the contents of which are hereby incorporated by referenced.

FIELD OF THE INVENTION

The present invention relates to processes and apparatus for the regeneration of particulate catalysts in a dense phase transport mode and separation of particulate catalyst from the gas stream.

BACKGROUND OF THE INVENTION

Contact between catalyst particles and gaseous reactants routinely occur in reaction vessels for production of chemicals, the conversion of hydrocarbons, or the rejuvenation of catalyst. Typically process arrangements retain the catalyst. in a fixed bed, as a semicontinuously moving bed or in a fluidized state. An increasing number of reaction arrangements are practiced or proposed for the fluidized transport and contacting of particulate catalyst with gas streams. Such processes include catalytic cracking of hydrocarbons, dehydrogenation processes, and olefin production from methanol.

In a fluidized system, catalyst particles are transported like a fluid by passing gas or vapor through the particles at a sufficient velocity to eliminate friction between the catalyst particles and to produce a desired regime of fluid behavior with the solid particles. Fluidized catalyst systems are most useful for processes that have rapid catalyst deactivation. Most of these processes rapidly lay coke down on the catalyst as a by-product of the reaction. Coke deactivates the catalyst. The fluidized transport provides the necessary high circulation of solids between a reaction zone that generates the coke and a regeneration zone that removes coke from the catalyst. High catalyst circulation, also referred to as catalyst mass flux, is a key to controlling the accumulation of coke on the catalyst. Conventional regeneration operations oxidatively combust coke from the surface of the catalyst to reduce the coke levels before returning the catalyst to the reaction zone.

The fluidized catalytic cracking of hydrocarbons is the most familiar example of a fluidized catalytic reaction system. In the FCC process, large hydrocarbon molecules associated with a heavy hydrocarbon feed are cracked, thereby producing lighter hydrocarbons. These lighter hydrocarbons are recovered as products, primarily gasoline, and can be used directly or further processed to raise the octane barrel yield relative to the heavy hydrocarbon feed. The FCC process is carried out by contacting the starting material—whether it be vacuum gas oil, reduced crude, or another source of relatively high boiling hydrocarbons—with a catalyst made up of a finely divided or particulate solid material. Contact of the oil with hot fluidized catalyst catalyzes the cracking reaction. During the cracking reaction, coke deposits on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place.

The basic equipment or apparatus for the fluidized catalytic cracking of hydrocarbons has been in existence since the early 1940's. The basic components of the FCC process include a reactor, a regenerator, and a catalyst stripper. The reactor includes a reaction zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by countercurrent contact with steam or another stripping medium. The stripping medium displaces hydrocarbon vapor from the interstitial space between catalyst particles and from the internal pore volume of the catalyst particles. Catalyst is traditionally transferred from the stripper to a regenerator for purposes of removing the coke by oxidation with an oxygen-containing gas. An inventory of catalyst having a reduced coke content relative to the catalyst in the stripper, hereinafter referred to as regenerated catalyst, is collected in the regeneration zone for return to the reaction zone.

Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then is circulated again to the reaction zone. The fluidized catalyst, as well as providing a catalytic function, acts as a vehicle for the transfer of heat from the regeneration zone to the reaction zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst-to-oil ratio) and contact time between the catalyst and feedstock. The most common method of regulating the reaction temperature is by regulating the rate of circulation of catalyst from the regeneration zone to the reaction zone which simultaneously produces a variation in the catalyst-to-oil ratio as the reaction temperatures change. That is, if it is desired to increase the conversion rate, an increase in the rate of flow of circulating fluid catalyst from the regenerator to the reactor is effected. As a result, the rate of catalyst circulation through the regeneration zone varies throughout the routine operation of the process.

Separate and distinct separation systems are used to separate gases from particles on both the reaction and regeneration sides of the process. Each system will use a two-stage separation with a first initial disengagement stage that separates most of the particles from the gas and a secondary separation stage that further reduces the particulate levels in the gas stream.

After particulate removal, the cracked hydrocarbons of the FCC reaction are recovered in vapor form and transferred to product recovery facilities. These facilities normally comprise a main column for cooling the hydrocarbon vapor from the reactor and recovering a series of heavy cracked fractions which usually include bottom materials, cycle oil, and heavy gasoline. Lighter materials from the main column enter a concentration section for further separation into additional product streams. The heaviest fraction of the separated hydrocarbon vapors will contain any residual particulate material that enters with the incoming vapors. Thus, particulate material that is not recovered by the separation systems of the reactor may still be readily recovered downstream in the heaviest hydrocarbon fractions.

Following separation of particulate material in the regeneration zone, flue gases undergo appropriate treatment for removal of pollutants such as sulfur and nitrogen compounds and particulate material and are then discharged to the atmosphere. Therefore, recovering as much particulate material as possible from the flue gas is especially important on the regenerator side of the process to avoid discharge of particulate material to the atmosphere and to reduce downstream treatment costs for the flue gas. The minimization of catalyst particle carryover has become of increasing concern due to environmental restrictions on the discharge of particulate materials. Consequently, all commercially practiced separation systems for regenerators rely exclusively on a two-stage cyclone system for removing the fine particles of entrained catalyst from the gases before the gases exit the system. As a result, a firmly entrenched practice has evolved wherein two stages of cyclone separators are used to minimize any carryover of catalyst particles with the flue gas exiting the regeneration vessel.

Different consideration and criteria have influenced the approach to separating catalyst from gas streams on the reactor and the regenerator sides of the process. The reactor vapors are not discharged to the atmosphere; as a result, higher catalyst loadings do not generate air pollution concerns. Since contact time between catalyst and reactants can have profound effects on product quality, quick separation of catalyst from reaction vapors is sought. On the regeneration side, contact time between flue gases and catalyst is less critical and fast separation has not been sought. Consistent high efficiency separation is the primary goal on the regeneration side of the process.

For many years, the reactor and regenerator side of the process operated with a large open vessel that served as a disengaging chamber for an initial separation of the catalyst from the product vapors. The large volume of the vessel provided an initial gravitational or settling type separation of particles from the gases. It was commonplace for the gravitational separation to occur in a dilute phase above a large dense phase catalyst bed. (The terms "dense phase" and "dilute phase" catalysts as used in this application are meant to refer to the density of the catalyst in a particular zone. The term "dilute phase" generally refers to a catalyst density of less than 20 lbs/ft$^3$ and the term "dense phase" refers to catalyst densities above 30 lbs/ft$^3$. Catalyst densities in the range of 20–30 lbs/ft$^3$ can be considered either dense or dilute, depending on the density of the catalyst in adjacent zones or regions.) Rising gases from a large open vessel go through a further stage or stages of inertial separation, most often in one or more stages of cyclone separator. The diameter of the large vessel was sized to maintain a superficial gas velocity upward through the regeneration vessel at a rate selected to minimize the entrainment of catalyst particles above the surface of the bed and ultimately into the cyclone separators.

In an effort to reduce residence time, the reactor side of the process replaced the initial stage of gravitational separation with a more contained inertial separation that reduces contact time between the catalyst and hydrocarbon vapors. Examples of such contained inertial systems are direct connected cyclones (U.S. Pat. No. 4,737,346), enclosed ballistic separation (U.S. Pat. No. 4,792,437), and a tangential entry separator (U.S. Pat. No. 4,482,451). In addition to providing the desired reduction in dilute phase residence time of the hydrocarbon vapors, the replacement of the initial gravitational separation with inertial separation provided a more compact and cost effective design for the reactor side of the process.

Despite changes to the reactor separation system, the early and current regeneration process arrangements continue to use relatively large regeneration vessels as a settling zone for an initial division between fine catalyst particles and flue gases that then traditionally enter two downstream stages of cyclone separators. The large disengagement vessel provides consistent disengagement despite changes in catalyst circulation rate or pressure surges in the regeneration zone. The consistent, initial separation of the catalyst provided by the gravitation or settling disengagement of catalyst from flue gases prevents overloading of the cyclones and maintains the high separation efficiency desired to minimize entrainment of catalyst beyond the regeneration zone cyclones. Providing the large volume disengaging vessel and dual stages of cyclones on the regeneration side of the process affects the design of the regeneration vessel and imposes additional costs on the construction of regeneration vessels and the associated equipment. Proposed regeneration arrangements that have eliminated the large disengaging vessel still regularly employ at least dual stages of cyclones to provide the required separation of efficiency and do not address the potential for cyclone overload and temporary carryover of catalyst from the regeneration zone.

The mechanics of the regeneration process also reinforced the perceived need for a dilute phase regenerator. As the oxygen-containing gas contacts the coke on the catalyst particles at high temperature, reaction of the coke with oxygen forms CO as the principal reaction product and regenerates catalyst particles. Along with the conversion of coke to CO, a secondary reaction of converting CO to $CO_2$ also occurs in the regeneration of the catalyst particles. Both reactions are highly exothermic. Catalyst densities in the large disengaging vessel are typically 1 lb/ft$^3$ or less. Operators of the early dense phase regenerators were concerned that combustion of CO to $CO_2$ in the dilute phase above the catalyst bed of the regeneration vessel would generate high amounts of heat without the presence of a sufficient heat sink, i.e., catalyst, to prevent temperature excursions which could exceed 1500° F. Accordingly, regeneration vessels operated with limited air or oxygen addition to the catalyst bed to prevent the breakthrough of oxygen above the bed into the dilute phase of the regeneration vessel. Transport risers that operated with excess oxygen and a relatively dense catalyst phase were added above the dense bed to complete combustion of CO to $CO_2$ in regeneration zones. The transport zone operated with catalyst densities in the range of from 5 to 10 lbs/ft$^3$ and superficial gas velocities of about 10–25 ft/sec.

In addition to the reactions and catalyst separation, fluidized systems must also provide the necessary hydraulics for the transport of the particulate material between the different zones. Elevation of particulate material to a particular zone for purposes of catalyst transport to a subadjacent zone can be accomplished by a conduit dedicated solely for a lift purpose, but is more efficiently conducted when the lift step provides an additional function. In regenerator arrangements where regenerated catalyst is transferred to an elevated location of the reactor, the lifting of catalyst is usually taking place relatively independently from the regeneration of the catalyst by coke oxidation. Coke oxidation is primarily carried out in a dense phase where long residence time contacting between the catalyst particles and oxygen can take place. Lifting of the catalyst is usually occurring after dense phase oxidation of coke from the catalyst with minimal initial oxidation of coke in a dilute phase. Using a more dense phase combustion zone for combined transport and regeneration of catalyst has more susceptibility to variations in catalyst loading on the separation system; therefore, transport conduits for regenerated catalyst have generally been limited to relatively low densities that inhibit the essentially complete removal of coke from catalyst for full regeneration and are used with multiple stages of cyclones.

U.S. Pat. No. 3,843,330 disclose a regeneration apparatus that regenerates FCC catalyst by transporting the catalyst from a dense bed through a dilute phase transport riser and discharge catalyst from the riser through multiple outlets or separation devices. These devices include an open nozzle, a downwardly directed arm, and a cyclone.

It is an object of this invention to provide an initial separation system for a regeneration process which operates with a high separation efficiency and which can accommodate temporary catalyst loadings.

It is a further object of this invention to provide an initial separator of regenerated catalyst and gases that is compatible for use with a dense phase lift conduit for transport and simultaneous combustion of coke from catalysts.

It is a yet further object of this invention to operate a large volume combustor riser in a regeneration process with a single stage of cyclones and to provide catalyst lift for simplifying hydraulics.

It is a further object of this invention to operate a combustion riser such that the discharge of catalyst from the riser permits the use of single-stage cyclones and has suitable flexibility in the operation to accommodate changes in density without overloading the cyclones.

DISCLOSURE STATEMENT

U.S. Pat. No. 4,792,437 discloses a ballistic separation device.

U.S. Pat. No. 4,295,961 shows the end of a reactor riser that discharges catalyst and cracked hydrocarbons into a reactor vessel and an enclosure around the riser that is located within the reactor vessel.

U.S. Pat. No. 4,737,346 shows a closed cyclone system for collecting the catalyst and vapor discharge from the end of a riser.

U.S. Pat. No. 2,902,432 shows a regeneration zone having a combustion stage that discharges regenerated catalyst through an open outlet conduit into a disengaging vessel.

U.S. Pat. No. 3,909,392 shows a regeneration apparatus having a dense bed in a regeneration vessel and a riser for transporting catalyst and combusting coke in an upward dilute phase transport mode. The patent also shows means for adding steam to the upper section of the regeneration vessel for control of excessive temperatures.

U.S. Pat. No. 4,397,738 and 4,482,451 show an FCC reaction zone with a riser that tangentially discharges a mixture of catalyst and reactants into a reactor vessel or a separate disengaging vessel.

U.S. Pat. No. 4,985,136 and 4,944,845 disclose an FCC process that uses a regenerator lift riser for short duration contact time of reactants and catalyst.

BRIEF DESCRIPTION OF THE INVENTION

Surprisingly, it has been found that a combination of a high volume FCC combustion riser and a tangential discharge apparatus at the end of the combustion riser can operate with only one stage of cyclones while providing suitable catalyst recovery—even during periods of density instability in the combustion riser. Therefore, in this invention, a particulate catalyst is regenerated by upward transport in a combustor having an extended length and is separated from combustion gases with a single stage of cyclones. The extended length combustor ends with a termination device arranged to tangentially discharge particulate catalyst and gases into a low volume disengaging vessel and to achieve a high separation efficiency. Initial high separation efficiency provided by the termination device permits a single downstream stage of cyclones to reduce particulate emissions to acceptable levels. The combination of the separation device and the extended combustor can accommodate changes in catalyst densities in the extended combustor without inducing cyclone overload.

Accordingly, in a broad process embodiment, this invention is a regeneration process for the oxidative combustion of coke from particulate catalyst, the fluidized transport of the particulate material through the regeneration process, and the separation of the particulate material from combustion gases using a single stage of cyclone separators. The process comprises passing the particulate catalyst having coke contained thereon to a regeneration zone, contacting the coke-containing catalyst with an oxygen-containing gas at coke oxidation conditions and transporting the coke-containing catalyst upwardly in a combustor riser at a catalyst density of from 3 to 20 lbs/ft$^3$ while combusting coke and producing combustion gases. Catalyst and combustion gases are discharged tangentially from the combustor riser through discharge openings defined by at least two discharge arms into an outer portion of a separation vessel that surrounds the combustion riser, and at least 90% of the catalyst from the combustion gases are separated in the separation vessel. Combustion gases are recovered from a central portion of the separation vessel and are passed directly to a cyclone separator to separate additional catalyst from the combustion gases. Separated catalyst from the combustion riser is collected in a lower portion of the separation vessel for delivery to a reaction zone.

In a further process embodiment, this invention is a process for the fluidized catalytic cracking of hydrocarbons that passes spent catalyst having coke contained thereon to a regeneration zone, contacts the coke-containing catalyst with an oxygen-containing gas at coke oxidation conditions and transports the coke-containing catalyst upwardly in a combustor riser at a catalyst density of from 3 to 20 lbs/ft$^3$. The process combusts essentially all coke from the catalyst to produce combustion gases and regenerated catalyst. The combustion riser discharges the regenerated catalyst and combustion gases tangentially from the combustor riser through discharge openings defined by at least two discharge arms into an outer portion of a separation vessel that surrounds the combustion riser and separates at least 90% of the regenerated catalyst from the combustion gases in the separation vessel. Combustion gases are recovered from a central portion of the separation vessel and passed to a single stage of a cyclone separator to separate additional regenerated catalyst from the combustion gases. Separated regenerated catalyst is collected from the combustion riser in a lower portion of the separation vessel. Regenerated catalyst is passed from said separation vessel to a reaction zone and contacted therein with a hydrocarbon feedstock at catalytic cracking conditions to produce cracked product vapors and spent catalyst having coke deposited thereon. Cracked hydrocarbon vapors are separated from the spent catalyst and a cracked hydrocarbon product stream is recovered while the spent catalyst is returned to the regeneration zone.

In an apparatus embodiment, this invention is an apparatus for the fluidized catalytic cracking of hydrocarbons. The apparatus comprises an elongated combustion riser having a length-to-diameter ratio of at least 5, a spent catalyst conduit for delivering spent catalyst to the combustion riser, and means for supplying combustion gas to the combustion riser and passing a stream of catalyst and combustion gases up the combustion riser. The combustion riser extends into a central portion of a separation vessel. At least two curved conduits are located in the separation vessel. The curved conduits communicate with and extend radially from the combustion riser. Each curved conduit defines a discharge opening and has an arrangement for the tangential discharge of the catalyst and a combustion gas stream into the separation vessel. A gas recovery conduit defines a gas inlet located radially inward from the discharge opening for collecting gaseous fluids from the separation vessel. A cyclone separator is in communication with the gas recovery conduit. A regenerated catalyst conduit is provided for withdrawing regenerated catalyst from the separation vessel. A reaction vessel communicates with the regenerated catalyst conduit to receive regenerated catalyst and communicates with a spent catalyst conduit to supplying spent catalyst to the combustion riser.

Other objects, embodiments, and details of this invention will be provided in the following detailed disclosure of the invention.

DETAILED DESCRIPTION OF THE INVENTION

Figure 1:
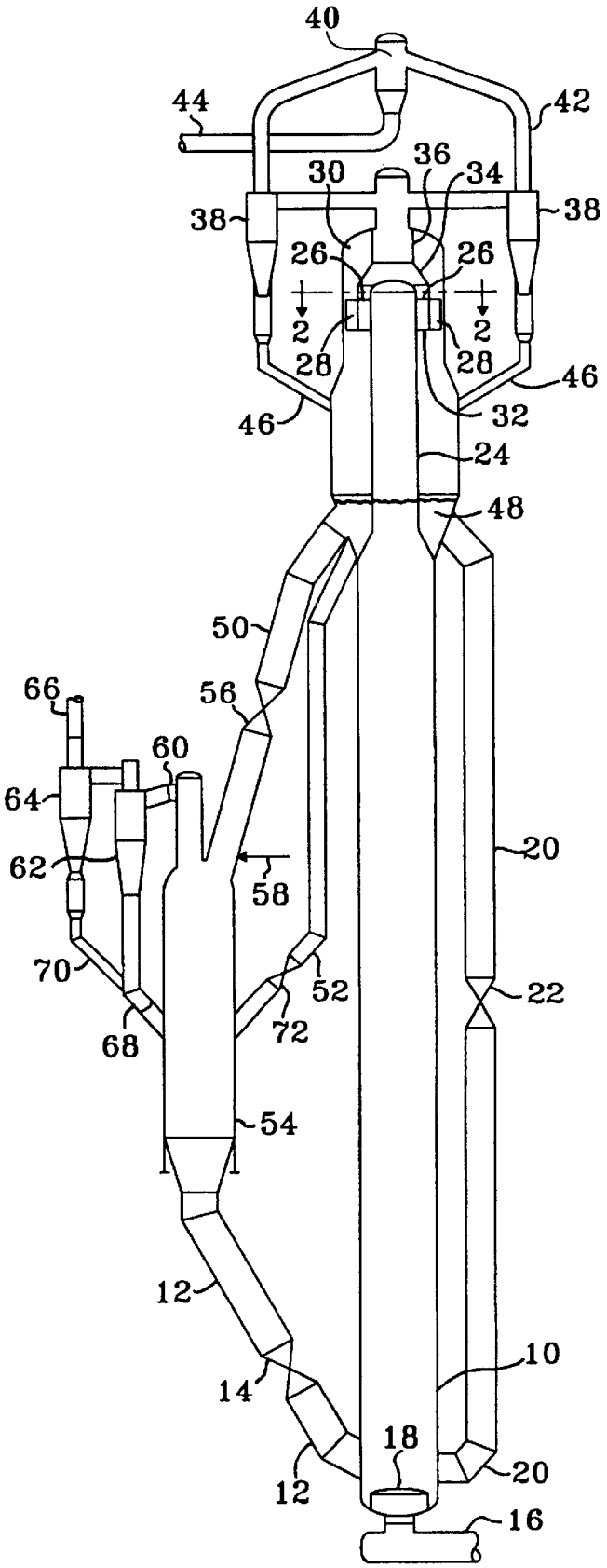
FIG. 1 is a sectional elevation showing the regenerator arrangement of this invention with a reactor arrangement.

The regeneration process and apparatus of this invention can find application in a wide variety of processes where fluidized catalyst is regenerated by the oxidative combustion of coke. The process is particularly suited for applications where a complete combustion of coke from the catalyst is desired and relatively large amounts of coke are laid down on the catalyst. Particularly useful processes will be those wherein catalyst undergoing regeneration have coke contents of 2 wt-% and higher. The invention is particularly useful for regenerators that provide a large amount of lift to retain catalyst at a suitable elevation for transfer into a reactor vessel.

The regenerator arrangement of this invention incorporates a combustion riser having an extended length. The combustion riser will operate at relatively dilute phase conditions over essentially its entire length. The coke-containing spent catalyst will enter the bottom of the combustion riser where it is mixed with a regeneration gas. The regeneration gas is an oxygen-containing gas which is typically air that is injected through a distributor into the bottom of the combustion riser. The distributor provides a uniform injection of the regeneration gas across the entire cross section of the combustor. In order to increase the combustion rate of coke from the spent catalyst, regenerated catalyst may be mixed with the spent catalyst at the bottom of the combustion riser and/or anywhere along the vertical length of the combustion riser.

It has been found that combustion of coke within the riser is more effective than previously believed and that an essentially complete combustion of coke can be obtained by contacting of catalyst in the relatively dilute phase in the combustion riser. The dilute phase of the combustion riser will have a catalyst density of from 3 to 20 lbs/ft$^3$ and, more preferably, from between 3 to 15 lbs/ft$^3$. Superficial gas velocity within the combustion riser will usually be at least 7 ft/sec and, more typically, will be in a range of from 7 to 20 ft/sec. Normally, at these conditions, complete combustion of coke from the catalyst can be obtained with a residence time of at least 30 seconds and, more typically, from 30 to 60 seconds when the catalyst entering the regenerator has a coke content of from 0.5 to 1.0 wt-%. Complete combustion of coke will produce catalyst particles having carbon concentrations of from 0.01 to 0.3 wt-%. Longer residence times will result in the combustion riser having an extended length. The extended length of the combustion riser will usually result in a length-to-diameter ratio of at least 5. Some variation in the superficial velocity and catalyst density may occur as a result of changes in the configuration of the combustion riser over its length. In particular, the upper diameter section of the combustion riser may be reduced to accommodate the separation apparatus at the end of the combustion riser.

An essential element of this invention is the discharge of the catalyst and gas mixture from the combustion riser into a separation vessel using an arrangement of tangential arms. In this manner, the separation vessel provides an initial stage of catalyst and gas separation. The tangential arms will normally extend horizontally from the combustion riser to an outer periphery of a separation vessel that surrounds the end of the combustion riser. The tangential discharge of the gas and catalyst mixture will provide a high efficiency separation. The high efficiency separation will usually achieve at least 90% separation of catalyst from the exiting gases and, more typically, will achieve at least 98% separation of catalyst from gases. Catalyst separated from the tangential discharge apparatus is retained in a dense bed typically located in the bottom of the separation vessel. Preferably, the volume of the separation vessel, especially around the tangential arms, is minimized to reduce overall regenerator costs and to promote higher efficiency from the separation. The diameter of the separation vessel at the location of the arms will usually be in a range of from 1.5 to 3 times the diameter of the adjacent section of the internal riser. Farther below the arms, the separation vessel diameter may be enlarged to increase available volume for catalyst inventory or to accommodate geometric layout demands associated with structural requirements for nozzles and standpipe conduits.

Combustion gases having a majority of the catalyst separated therefrom are removed from the separation vessel. The gases from the initial separation are removed from a more central portion of the separation vessel. The more central location for the removal of the initially separated combustion gas is at least to the inside of the discharge openings. Combustion gases withdrawn from the separation vessel flow into another stage of separation that reduces the catalyst loading to levels usually acceptable for discharge from a regenerator. Such loadings are usually less than 10 lbs of particulates per 100 lbs of coke burned. In accordance with this invention, a single stage of cyclone separators is sufficient to provide the necessary further reduction of catalyst from the combustion gases. The additional stage of cyclones may be located externally to the regeneration vessel, within the regeneration vessel, or contained within a separate cyclone vessel. Thus, the regeneration vessel may be a larger vessel that surrounds the cyclones as well as the separation vessel at an upper portion of the regenerator. The cyclone vessel is typically an independent vessel connected to the separation vessel by a gas recovery conduit.

Catalyst separated by discharge of the catalyst and gas mixture from the combustion riser collects in a lower portion of the separation vessel. Catalyst collected in a lower portion of the separation vessel will at least supply catalyst to the reactor. In addition, the catalyst inventory in the separation vessel may also provide regenerated catalyst for recirculation to the combustion riser as previously described. The separation vessel catalyst inventory may also serve as a source of hot catalyst for facilitating stripping of spent catalyst.

Figure 2:
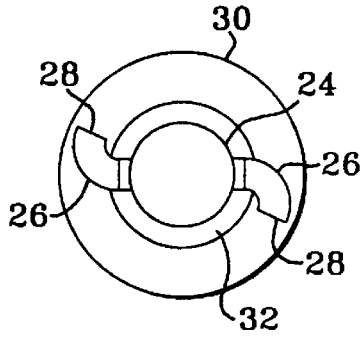
FIG. 2 is a plan view of a tangential discharge arrangement taken at section 2—2.
Figure 3:
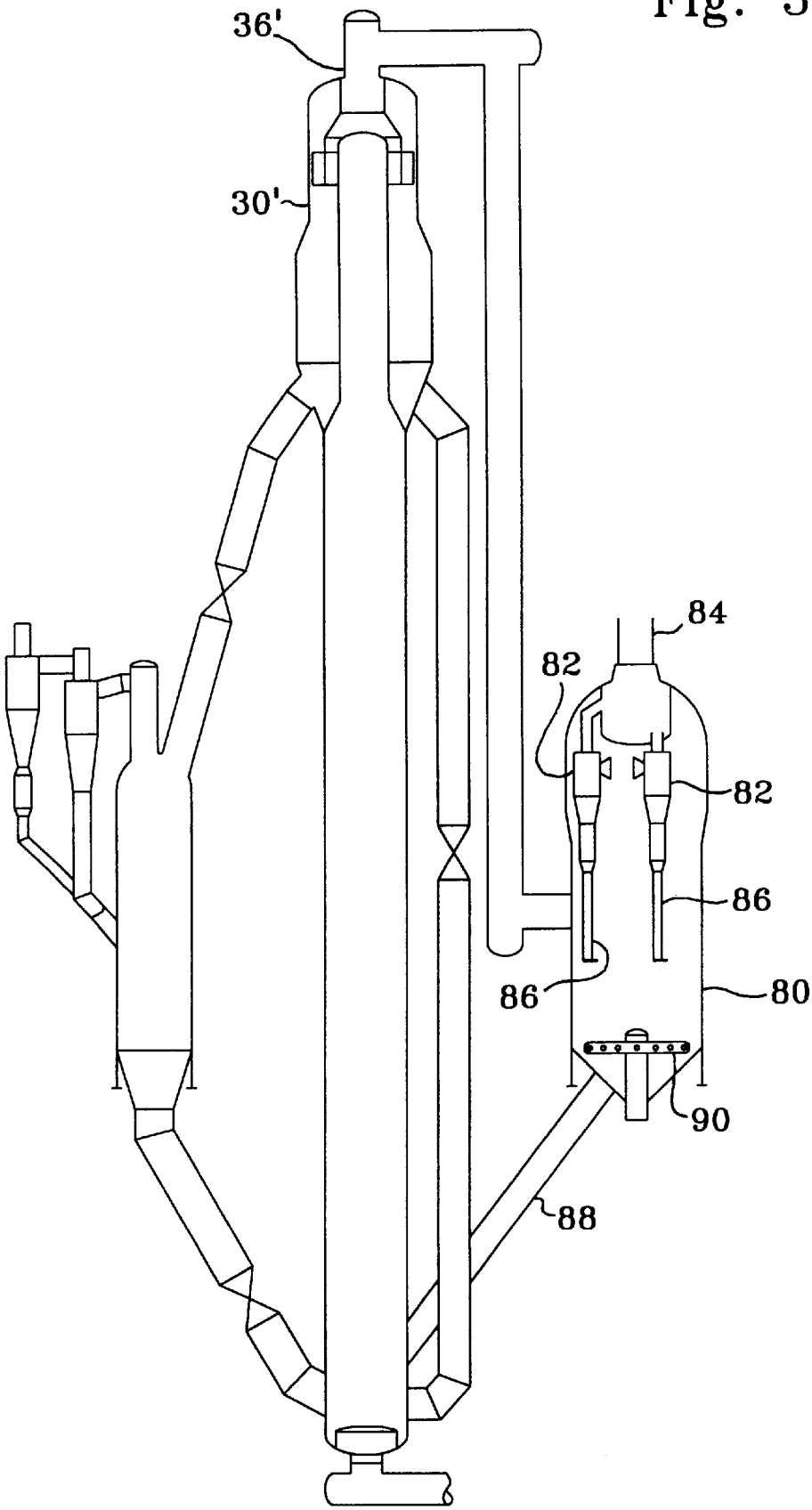
FIG. 3 is an alternate arrangement for the regenerator shown in FIG. 1.

Further description of this invention will be done in the context of FIGS. 1, 2, and 3 which show arrangements for the fluidized catalytic cracking of hydrocarbons. The further description of this invention in the context of the fluidized catalytic cracking arrangement is not meant to restrict the broader application of this invention to fluidized regeneration processes.

Looking then at FIG. 1, a combustion riser 10 receives spent catalyst from a spent catalyst conduit 12 at a rate regulated by a control valve 14. A conduit 16 supplies air to a distributor 18 that distributes the regeneration gas across the cross-section of combustion riser 10. Regenerated catalyst having a higher temperature than the spent catalyst is supplied to the combustion riser by a recirculation standpipe 20 at a rate regulated by a control valve 22. The dilute phase mixture passes up the combustion riser at a density in a range of from 3 to 20 lbs/ft$^3$ and at a superficial velocity of about 15 ft/sec. An upper section 24 of the combustion riser has a reduced diameter that raises the superficial velocity to about 55 ft/sec.

After a total residence time of about 30 seconds, the mixture of combustion gases and catalyst is discharged from the combustion riser through a pair of arms 26 and discharge openings 28. FIG. 2 shows the combustion riser arms 26 extending from combustion riser section 24 with a curved profile to orient discharge openings 28 in a tangential direction near the wall of the separation vessel 30.

Tangential discharge from openings 28 imparts an outward acceleration to the catalyst particles that causes them to disengage from the lighter combustion gases. The lighter combustion gases readily change direction and flow into gas inlet 32. Gas inlet 32 has an annular opening defined on its outside by a shroud 34 and on the inside by the outer wall of combustion riser section 24, a gas recovery conduit 36 transfers the combustion gases directly to a second stage of separation provided by cyclones 38. Cyclones 38 are located externally to separation vessel 30. A collection chamber 40 collects combustion gases from cyclone outlet tubes 42 and delivers a combined combustion gas stream to a flue gas line 44. The combustion gas stream from line 44 has less than 10 lbs of particulates per 1000 lbs of coke burned.

Catalyst separated by discharge from openings 28 flows downward through separation vessel 30 along with catalyst from cyclones 38 that reenters separation vessel 30 via dip legs 46. Catalyst collects at the bottom of the separation vessel 30 in a dense bed 48. Dense bed 48 supplies catalyst to a regenerated catalyst standpipe 50, a recirculation standpipe 20, and a stripper standpipe 52.

Regenerated catalyst flows to a reactor vessel 54 at a rate controlled by a control valve 56. A hydrocarbon feed 58 is injected into a concentrated stream of catalyst from standpipe 50 in reactor vessel 54. Contacting of the hydrocarbon feed deposits coke on the regenerated catalyst and produces spent catalyst which, in large part, passes downward into a lower portion of reactor vessel 54. Cracked hydrocarbon vapors along with entrained catalyst particles exit reactor vessel 54 through a recovery conduit 60. Recovery conduit 60 delivers hydrocarbon vapors and entrained catalyst to a series of external cyclones comprising a first stage of separation provided by a cyclone 62 and a second stage of separation provided by a cyclone 64. Hydrocarbon vapors relatively free of catalyst particles are recovered from cyclone 64 through a gas recovery tube 66.

Catalyst passing downwardly through reactor vessel 54 from the initial contact of catalyst is joined by additional catalyst recovered by cyclones 62 and 64. Cyclones 62 and 64 return catalyst to the reactor vessel by dip leg conduits 68 and 70. The lower portion of reactor vessel 54 will usually contain stripping grids (not shown) for desorption and displacement of hydrocarbons from the catalyst particles. Additional desorption of hydrocarbons is promoted by the addition of hot regenerated catalyst directly to the stripping zone via conduit 52 at a rate regulated by control valve 72. Spent catalyst standpipe 12 returns spent catalyst from reactor vessel 54 to the combustion riser in the manner previously described.

FIG. 3 shows a variation in the arrangement of the regeneration zone of FIG. 1 wherein a separate cyclone vessel 80 is provided to house the secondary stage of separation for the combustion gases. In FIG. 3, the gas recovery conduit 36! delivers the combustion gas from the initial stage of separation in separation vessel 30' to the cyclone vessel 80. Cyclone vessel 80 houses a plurality of single stage cyclones 82 that receive the incoming combustion gases and provide a second stage of separation that reduces the concentration of catalyst in the combustion gases to less than 10 lbs/1000 lbs of coke burned. After the further separation, the combustion gases are recovered by a flue gas line 84. Catalysts recovered by cyclones 82 pass out of the cyclones via dip legs 86 and into a lower portion of cyclone vessel 80. Catalyst that collects on the bottom cyclone vessel 80 is returned to the combustion riser via a cyclone conduit 88. In all other respects, the regenerator and reactor arrangement of FIG. 3 operates in the same manner as that previously described.

In addition to providing an alternate arrangement for housing the secondary stage of separation, cyclone vessel 80 may also use a distribution grid 90 to supply fluidizing gas for the purpose of moving catalyst through conduit 88.

What is claimed is:

1. An apparatus for the fluidized catalytic cracking of hydrocarbons, said apparatus comprising:

an elongated combustion riser having a length-to-diameter ratio of at least 10;

a spent catalyst conduit for delivering spent catalyst to said combustion riser; "a distributor at least partially inside said combustion riser" for supplying combustion gas to said combustion riser and passing a stream of catalyst and combustion gases up said combustion riser; "said length-to-diameter ratio being determined by the cross-section of said combustion riser at said distributor;"

a separation vessel having an upper portion of said combustion riser extending into a central portion thereof;

at least two curved conduits located in said separation vessel, said curved conduits communicating with and extending radially from said combustion riser, each curved conduit defining a discharge opening and having an arrangement for the tangential discharge of said stream into said separation vessel;

a gas recovery conduit defining a gas inlet located radially inward from said discharge opening for collecting gaseous fluids from said separation vessel;

a cyclone separator in communication with said gas recovery conduit;

a regenerated catalyst conduit for withdrawing regenerated catalyst from said separation vessel; and a reaction vessel for receiving regenerated catalyst from said regenerated catalyst conduit and supplying spent catalyst to said spent catalyst conduit.

2. The apparatus of claim 1 wherein said inlet is located in annular region bordered by said discharge openings and said combustor riser.

3. The apparatus of claim 1 wherein said regenerated catalyst conduit communicates with the top of said reactor vessel and said spent catalyst conduit communicates with the bottom of said reactor vessel.

4. The apparatus of claim 1 wherein said gas recovery conduit communicates with a cyclone vessel that houses a plurality of cyclone separators.

5. The apparatus of claim 1 wherein said gas recovery conduit communicates directly with said cyclone separator.

6. The apparatus of claim 1 wherein said gas inlet is located below said discharge opening.

* * * * *

UNITED STATES PATENT AND TRADEMARK OFFICE

CERTIFICATE OF CORRECTION

PATENT NO. : 6,491,875 B1
DATED : December 10, 2002
INVENTOR(S) : Paolo Palmas

It is certified that error appears in the above-identified patent and that said Letters Patent is hereby corrected as shown below:

Column 10,
Lines 51-58, should read as follows:
a spent catalyst conduit for delivering spent catalyst to said combustion riser;

a distributor at least partially inside said combustion riser for supplying combustion gas to said combustion riser and passing a stream of catalyst and combustion gases up said combustion riser, said length-to-diameter ratio being determined by the cross-section of said combustion riser at said distributor;

Signed and Sealed this

Twenty-seventh Day of May, 2003

JAMES E. ROGAN
*Director of the United States Patent and Trademark Office*